US006929293B2

(12) United States Patent
Tönges

(10) Patent No.: US 6,929,293 B2
(45) Date of Patent: Aug. 16, 2005

(54) DOOR LOCK, PARTICULARLY SLIDING DOOR LOCK WITH AUTOMATIC FUNCTION

(75) Inventor: Reiner Tönges, Heiligenhaus (DE)

(73) Assignee: Carl Fuhr GmbH & Co. KG, Heiligenhaus (DE)

( * ) Notice: Subject to any disclaimer, the term of this patent is extended or adjusted under 35 U.S.C. 154(b) by 0 days.

(21) Appl. No.: 10/360,471

(22) Filed: Feb. 6, 2003

(65) Prior Publication Data

US 2003/0160463 A1 Aug. 28, 2003

(30) Foreign Application Priority Data

Feb. 27, 2002 (DE) ..... 102 09 574

(51) Int. Cl.[7] ..... E05B 63/20
(52) U.S. Cl. ..... 292/332; 292/DIG. 46
(58) Field of Search ..... 292/336.3, DIG. 46, 292/332, 333, 335, 336, DIG. 21; 70/100

(56) References Cited

U.S. PATENT DOCUMENTS 1,047,900 A * 12/1912 Voight ..... 292/336
1,324,181 A * 12/1919 Smith ..... 292/336
2,781,218 A * 2/1957 Jewett ..... 292/336
2,793,896 A * 5/1957 Duvall ..... 292/165
5,542,720 A * 8/1996 Fleming ..... 292/32
5,566,991 A * 10/1996 Young ..... 292/201

FOREIGN PATENT DOCUMENTS

| | | |
|---|---|---|
| DE | 4110556 | 10/1992 |
| DE | 19636134 | 3/1998 |
| EP | 0385213 | 11/1992 |

* cited by examiner

*Primary Examiner*—Gary Estremsky
(74) *Attorney, Agent, or Firm*—Martin A. Farber

(57) ABSTRACT

A driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed positions, wherein the energy storing device (5) can be loaded by actuation of a latch nut (6) upon return of the at least one driving rod (2, 3) and released by a release mechanism. The release mechanism is formed by a blocking member (7) which holds the at least one driving rod (2, 3) in the closed position against return by the latch nut (6), wherein the latch nut (6) is blocked against rotation in the blocking position of the blocking member (7).

7 Claims, 6 Drawing Sheets

DOOR LOCK, PARTICULARLY SLIDING DOOR LOCK WITH AUTOMATIC FUNCTION

FIELD AND BACKGROUND OF THE INVENTION

The invention concerns a door lock, in particular a sliding door lock, with at least one driving rod starting from a lock housing, for driving at least one bolt element, wherein the at least one driving rod is displaceable by means of energy stored in an energy storing device after release of the energy storing device by discharge from a ready-to-close position into a closed position, wherein the energy storing device can be loaded by actuation of a latch nut upon return of the at least one driving rod and released by means of a release mechanism.

A door lock of the kind in question is known from EP 0 385 213 B1. In this, a lock housing is seated to the rear of a cuff plate. From the lock housing start two driving rods which run to the rear of the cuff plate and lead to bolt elements which are in the form of pivot catches or rolling-type pins there. Remote from the lock housing is located an energy storing device which acts on the driving rod in the blocking direction. Associated with the cuff plate is a release mechanism in the form of a lever. If this release mechanism encounters a stop or a striking plate, then the release mechanism releases the energy storing device. This results in the driving rod being displaced in the direction of the closed position. Accompanying this displacement, the closing elements are displaced into their closed position. The driving rods can be returned from the closed position to the release position by actuation of a latch nut. For this purpose a chain link linked to a nut arm engages a transmission lever which meshes with the driving rods. By pivoting the transmission lever, the driving rod is displaced. As a result of spring action on the release mechanism, the driving rod is captured and fixed in its open position.

An automatic lock is also previously known from DE 41 10 556. Here, release of the energy storing device is effected by synchronous displacement of a tracer protruding beyond the cuff plate, with a catch.

From DE 196 36 134 A1 is previously known an automatic lock in which a bolt, which is displaceable transversely to the direction in which the cuff plate extends, is advanced by action on the catch. Pushing the catch back triggers discharge of the energy storing device here.

It is the object of the invention to develop the generic lock in a manner which is advantageous for use.

SUMMARY OF THE INVENTION

Accordingly the invention provides that the release mechanism is formed by a blocking member which holds the at least one driving rod in the closed position against return by the latch nut. In a development of the invention it is provided that the latch nut is blocked against rotation in the blocking position of the blocking member. The blocking function is preferably performed by a blocking arm of a nut. The nut in this case is constructed as the blocking member. The release function is preferably performed by a release arm of the blocking member. The release arm of the nut preferably works against a pawl which holds the driving rod. This pawl is preferably arranged in the lock housing and mounted so as to be pivotable about a shaft. The blocking arm of the nut can in the blocking position place itself under a blocking shoulder of the driving rod. In a particularly preferred embodiment of a generic door lock it is provided that the pawl engages in a tooth system of the driving rod. This engagement in a tooth system causes a ratchet function when loading the energy storing device. This technical concept is of independent importance. As a result of this embodiment, loading of the energy storing device is facilitated. The energy storing device does not have to be loaded by a single pivot-actuation of a latch. On the contrary, the pivot-actuation of the latch can be interrupted. It is also possible to load the energy storing device in several individual actuations, wherein upon each individual actuation the pawl moves into another tooth-engaging position in order to fix the driving rod in an intermediate position. A driving rod connecting slide guided linearly in the lock housing is used for linear displacement of the driving rod. This driving rod connecting slide can be engaged by a transmission lever. This transmission lever is preferably of two-armed construction. With its longer arm the transmission lever engages the driving rod connecting slide. The shorter arm of the transmission lever can be engaged by an actuating arm of the latch nut. This engagement can be effected with play, so that the latch nut can be held by a spring assembly or the like in a central, neutral position. But it is also provided that the latch nut can be displaced only in the release direction, i.e. in the direction of loading the energy storing device. For this purpose a corresponding partial blocking of rotation of the nut can be provided. The shorter arm of the transmission lever can in this case comprise a drive cam which lies with play in a notch of the actuating arm. In a preferred embodiment of the invention which is likewise of independent importance, the blocking member in its release position is blocked from moving by a device preventing faulty operation. The path of actuation of the blocking member is blocked, so that the energy storing device cannot be released as long as the device preventing faulty operation is operative. The device preventing faulty operation can form a tracer. This tracer can extend through an opening of the cuff plate in order to strike the striking plate of the frame or of the stationary door leaf when closing a sliding door designed with the lock. This causes pivoting displacement of the lever which forms the device preventing faulty operation, and hence release of the means for blocking movement of the blocking member, so that a nut which forms the blocking member can be pivoted. This pivot movement leads to release of the energy storing device, wherein the release arm of the nut puts the pawl out of action. The pawl in the process leaves the tooth system to the driving rod connecting slide. As a result of the linear displacement of the driving rod out of the ready-to-close position into the closed position, which is caused by discharge of the energy storing device, the bolt elements are put into action. Linearly displaceable hook elements can be used as the bolt elements. Preferably, pivot catches which lie in catch receiving housings arranged to the rear of the cuff plate are used as the bolt elements. The device preventing faulty operation is preferably a two-armed lever. The first arm forms the tracer which extends beyond the cuff plate. The second arm forms a blocking step which places itself in the path of movement of the nut. The blocking step preferably cooperates with the release arm of the nut which forms the blocking member.

BRIEF DESCRIPTION OF THE DRAWINGS

A practical example of the invention is described below with the aid of attached drawings. They show.

DETAILED DESCRIPTION OF THE PREFERRED EMBODIMENT

Figure 1:
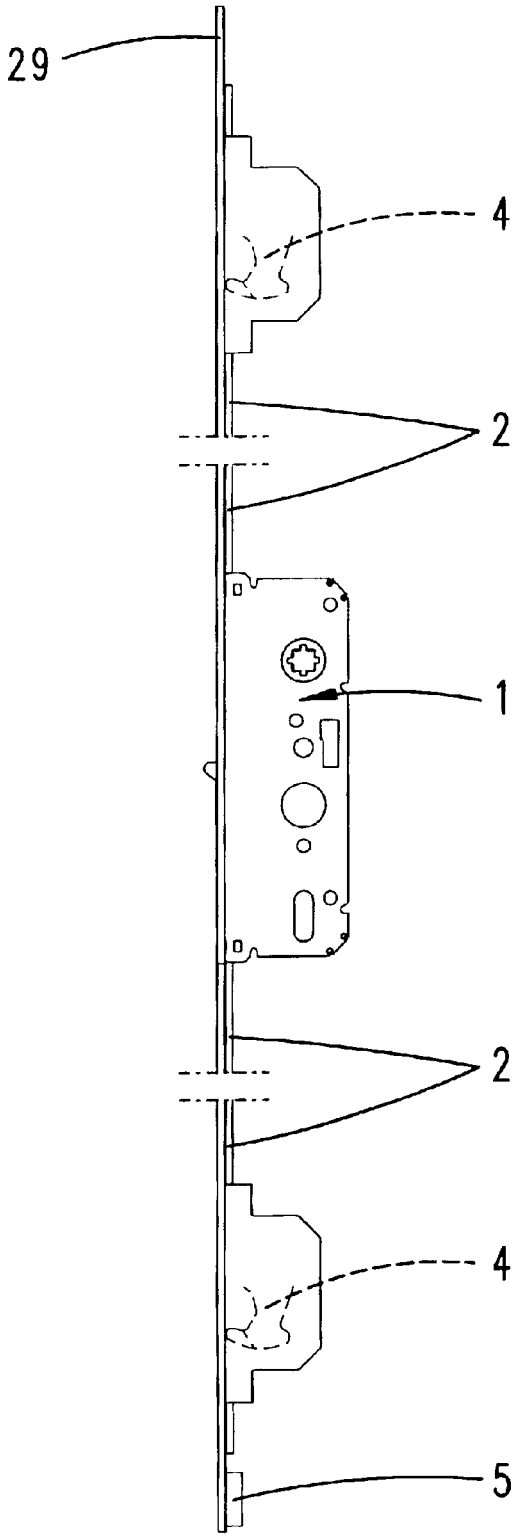
FIG. 1 a general view of the door lock.

To the rear of a cuff plate 29 runs a driving rod 2. This driving rod 2 is divided in two. An upper and a lower driving rod 2 is provided. The upper driving rod cooperates with a hooked catch 4 which is located in a hooked catch housing. The lower driving rod 2 too cooperates with a hooked catch 4 which is likewise located in a hooked catch housing 4. Below the hooked catch housing is located an energy storing device 5. This energy storing device 5 has a compression spring which is taut in the open position of the lock and which acts on the driving rod in the direction of the closed position of the lock.

In the lock housing 1, the driving rods 2 engage a driving rod connecting slide 3 which also belongs to the driving rod. In the lock housing 1 is seated a pawl 10 which is biased by a spring 26 in the blocking direction. The driving rod connecting slide 3 has a tooth system 12 in which blocking pins 23 of the pawl 10 engage to block the driving rod 2, 3 against displacement out of the open position into the closed position.

If the pawl 10 is displaced out of the blocking position, which is effected by pivoting thereof about the pivot shaft 25, then the driving rod 2 together with the driving rod connecting slide 3 can be displaced linearly. In the practical example, this displacement out of the open position into the closed position is an upward movement. This upward movement results in outward pivoting of the hooked catches through corresponding openings of the cuff plate.

Release of the pawl 10 is effected by action on the lever arm 24 of the two-armed pawl 10 by means of the release arm 9 of the nut.

The driving rod connecting slide 3 has a blocking shoulder 11 running obliquely to the direction of displacement. Upon further rotation of the nut 6, the blocking arm 8 places itself under this blocking shoulder 11 and so prevents the driving rod connecting slide 3 together with the driving rods 2 from being displaced into the open position by rotation of the latch nut.

If the blocking member 7 is displaced into the release position, the path of displacement of the driving rod connecting slide 3 is free.

An engaging cam 34 of a transmission lever 14 engages in a notch 33 of the driving rod connecting slide 3. The transmission lever 14 is mounted so as to be pivotable about a bearing shaft 17 fixed to the housing. The transmission lever 14 is of two-armed construction. The lever arm of the transmission lever 14 is formed by a drive cam 15. At the end of the longer lever arm of the transmission lever 14 is located the engaging cam 34.

The nut 6 has an actuating arm 13 which is connected integrally with the material of the nut 6. This actuating arm 13 overlaps the transmission lever 14. The drive cam 15 here engages in a notch 16 of the actuating arm 13. The drive cam 15 lies with play in the notch 16, so that the nut is held by means of a spring assembly 30 in a central, neutral position. Out of this central, neutral position, the nut can be rotated anti-clockwise to displace the transmission lever 14, with the aim of sliding the driving rod into the open position, which is accompanied by loading of the energy storing device 5. The nut could also be rotated in the opposite direction in order to displace the driving rod actively. But this is not provided in the practical example. There, the rotational movement of the nut out of the central, neutral position in a clockwise direction by means shown is blocked. As a result of this blocking, a handle engaging the latch nut can assume a vertical position in which it can be used to close a sliding door fitted with the lock. Release of the lock elements is then effected upon tracer action.

About a bearing shaft 35 fixed to the housing is mounted a two-armed lever 19. This lever 19 forms a device preventing faulty operation. One arm of the lever 19 forms a tracer which extends through a recess 36 of the cuff plate in order to cooperate with a striking plate 28. The tracer 20 is pivoted during closing of the door by action on the striking plate 28. The other arm of the lever 19 forms at its end a blocking shoulder 22 which in the operative position of the device preventing faulty operation 19 is located in the pivot-movement space of the release arm 9. If the release mechanism is actuated when the door is not closed, then the release arm 9 encounters the blocking shoulder 22. As a result of this, the lever arm 24 of the pawl 10 cannot be acted upon. Only when the device preventing faulty operation 19 is pivoted by impingement of the tracer 20 on the striking plate 28, does the blocking shoulder 22 move out of the pivot-movement space of the release arm 9, so that the latter can be pivoted against the lever arm 24.

The blocking member 7 which forms the release mechanism is constructed as a nut which is held by means of a leg spring 27 in its two pivot end positions, which are offset by 90°.

Figure 2:
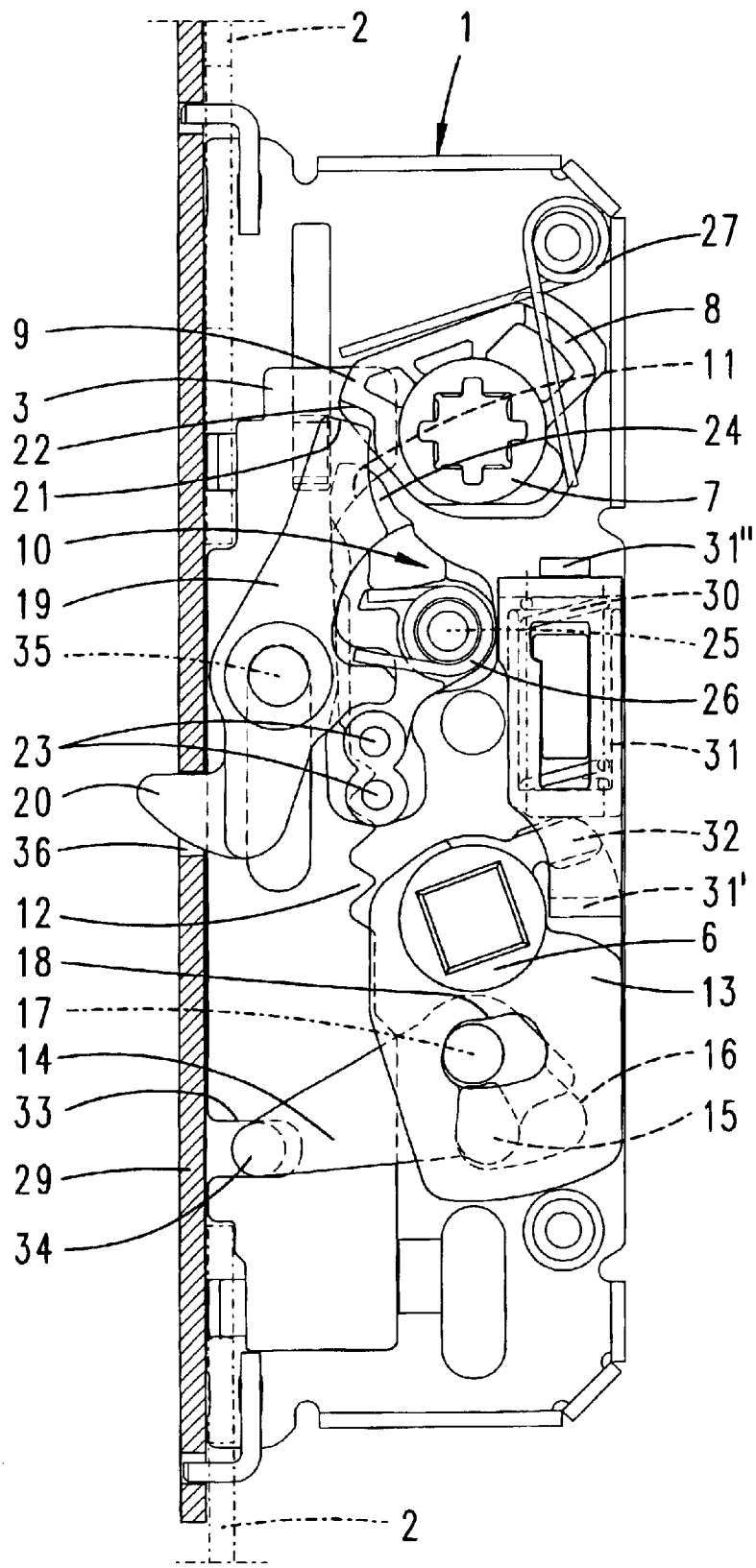
FIG. 2 an enlarged view of the lock housing with the housing cover removed, in the open position with the energy storing device loaded, FIG. 3 a view as in FIG. 2 with the blocking member turned through 8° towards the device preventing faulty operation, FIG. 4 a subsequent view as in FIG. 3 with the device preventing faulty operation put out of action, FIG. 5 a subsequent view to FIG. 4 with the pawl disengaged and the energy storing device discharging, and FIG. 6 a subsequent view to FIG. 5 with the blocking member put into action.
Figure 3:
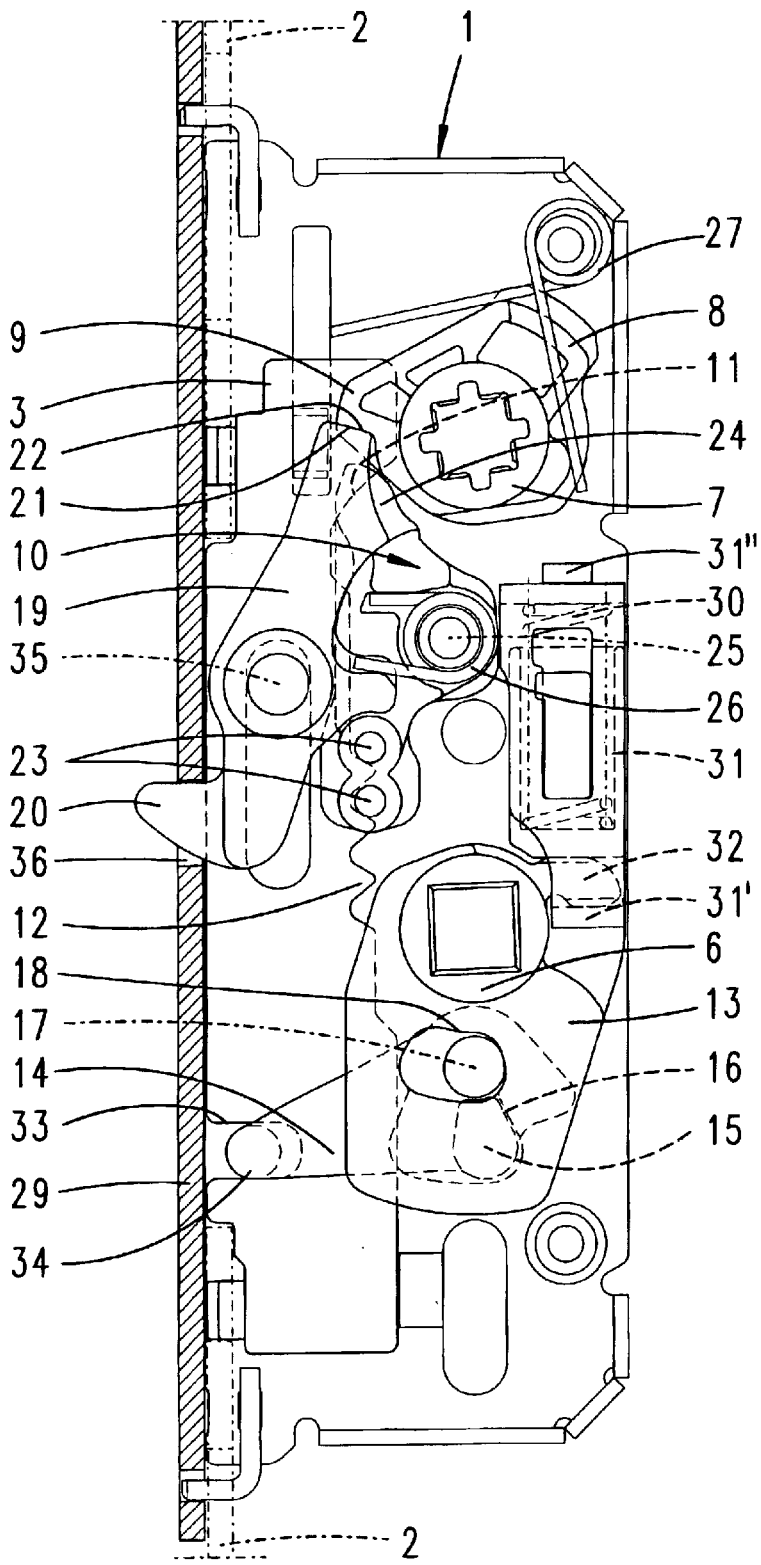
Figure 4:
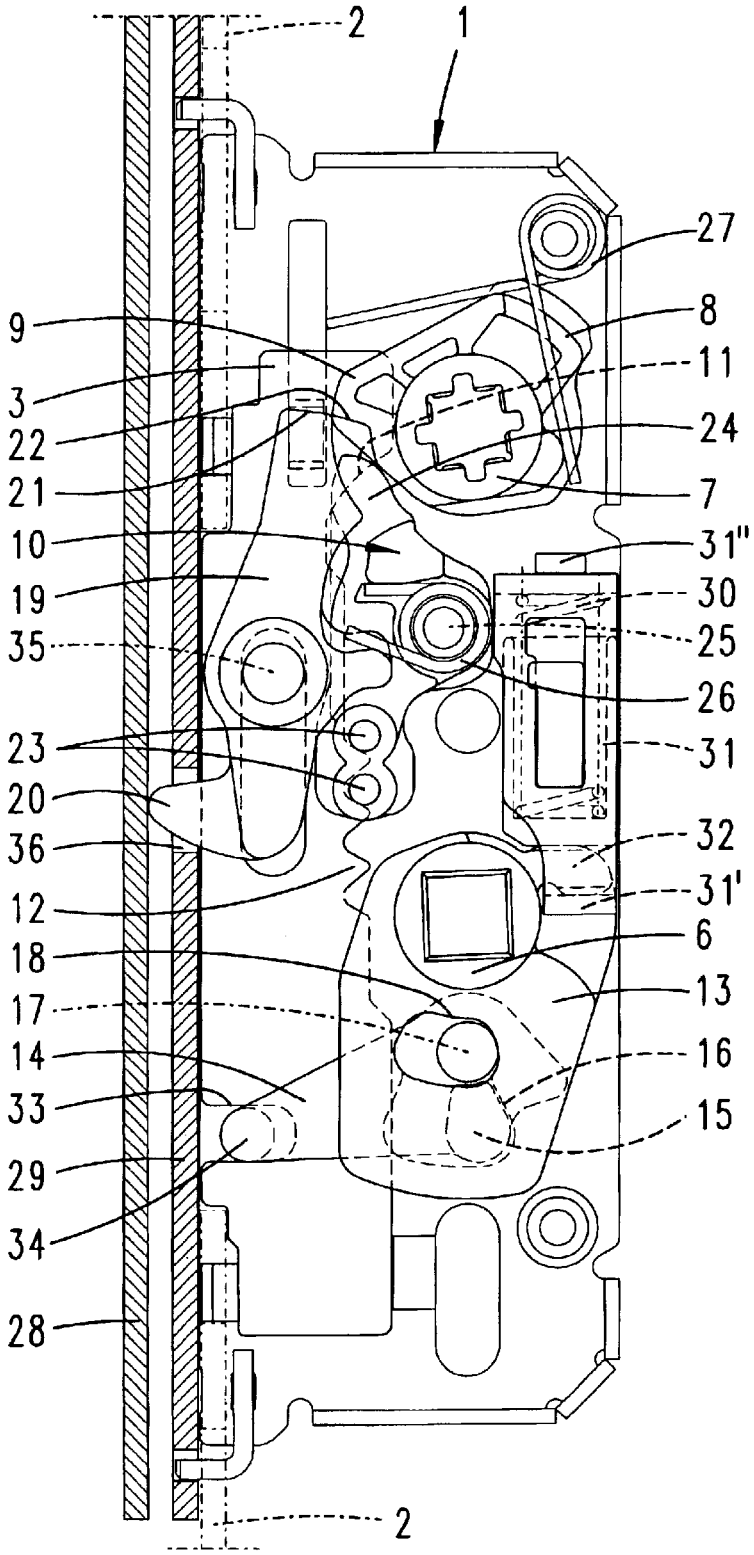
Figure 5:
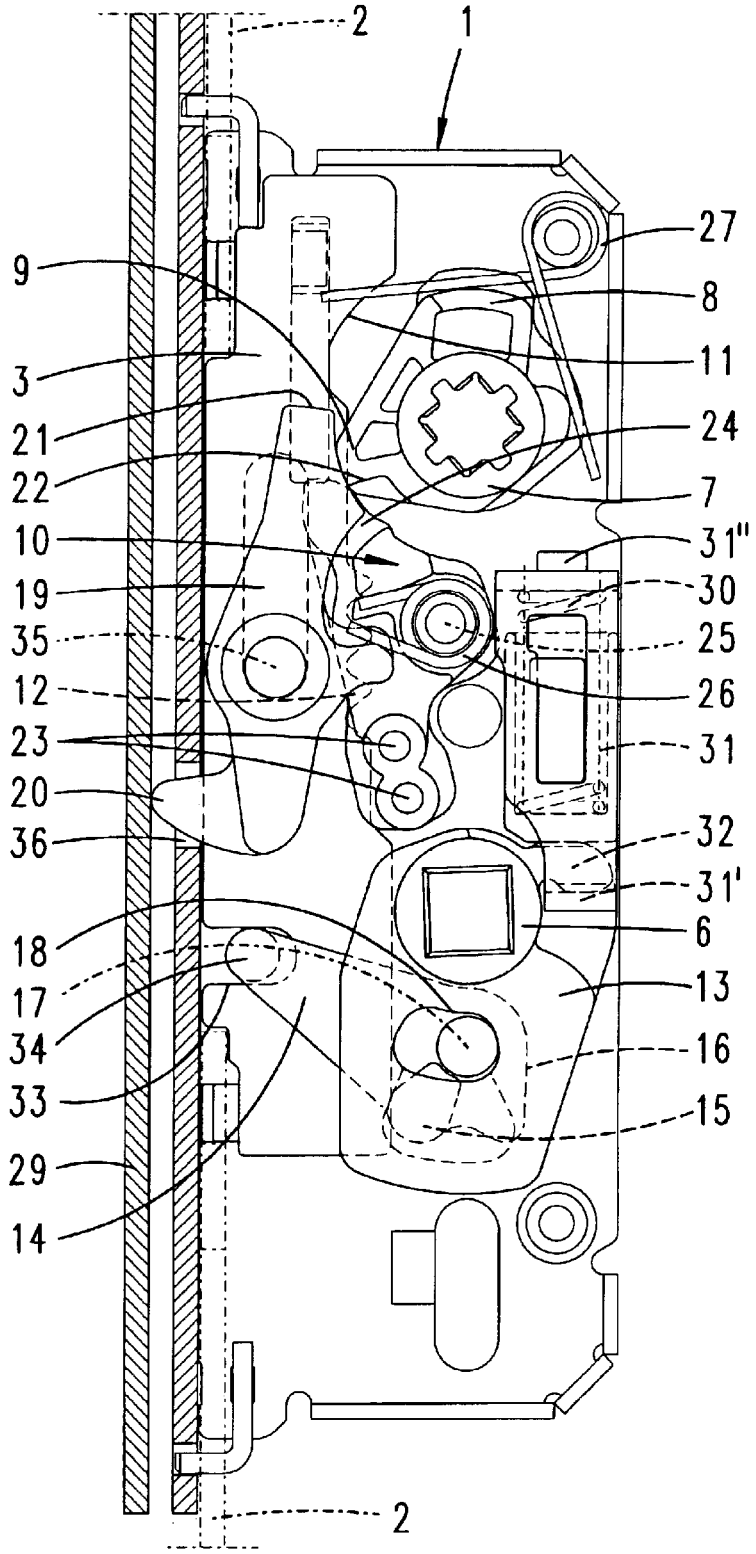

The manner of operation of the lock is the following:

Starting from the open position shown in FIG. 2, in which the hooked catches 4 are retracted, the blocking member 7 can be pivoted only through 8° as far as the operative position shown in FIG. 3. In this position the release arm 9 runs against the blocking shoulder 22. Only when, as shown in FIG. 4, the tracer 20 encounters a striking plate 28 and so the device preventing faulty operation 19 is pivoted, does the pivot movement space for the release arm 9 become free. The release arm 9 can then be pivoted further in order, as shown in FIG. 5, to pivot the pawl 10. As a result of pivoting of the pawl 10, the blocking pins 23 associated with the pawl 10 are disengaged from the tooth system 12, in order thus to unlock the driving rod or the driving rod connecting slide 3. The taut energy storing device 5 can be discharged. The driving rod is displaced upwards. The hooked catches 4 pivot outwards.

Figure 6:
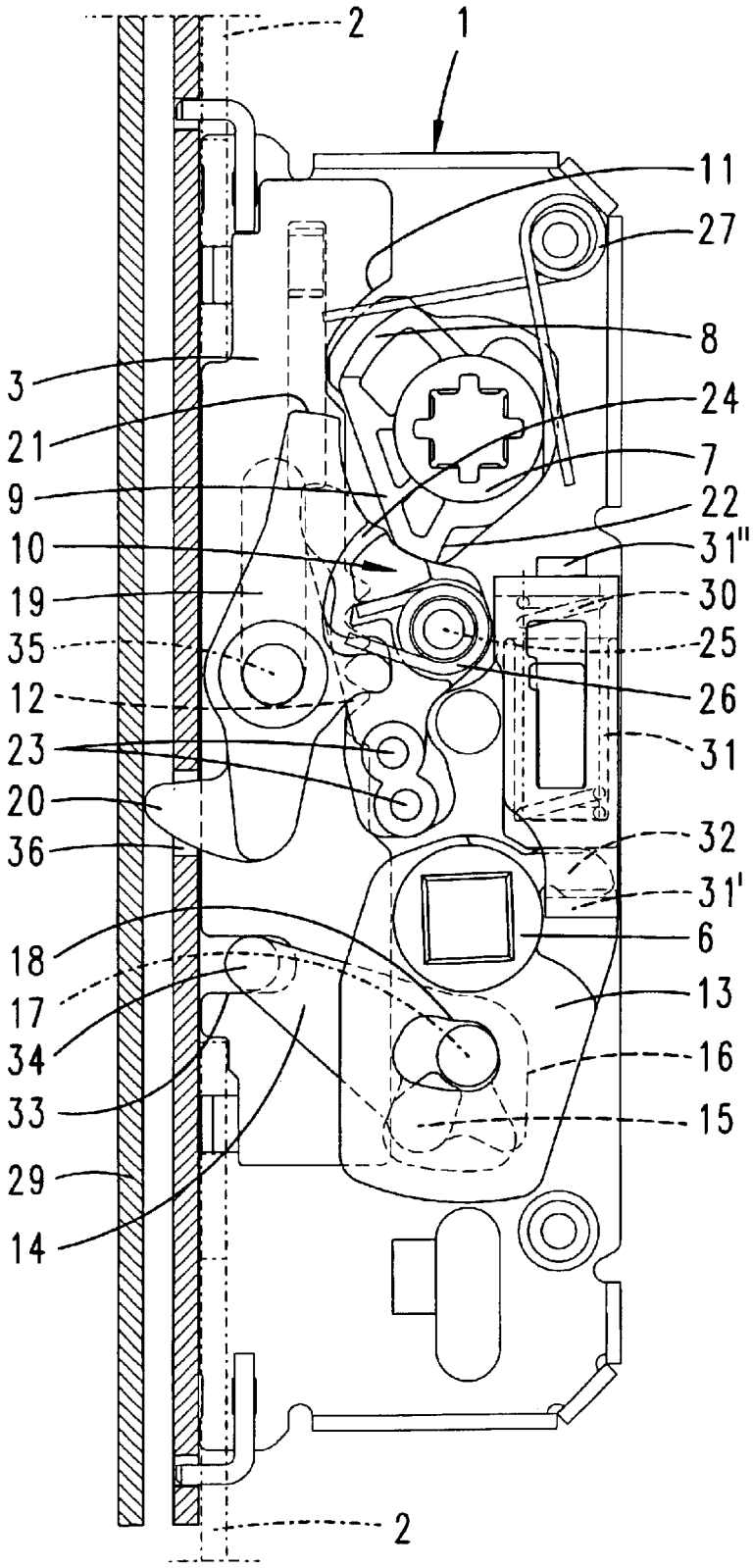

The blocking shoulder 11 in this position lies in an upwardly displaced position. As a result of this, the blokking arm 8 can be pivoted under the blocking shoulder 11 by further rotation of the nut 6. The driving rod 2, 3 in this position, which is shown in FIG. 6, cannot be displaced downwards by actuation of the latch nut 6.

If the lock is to be opened, then first the blocking member 7 must be displaced into the release position (FIG. 2) again. Then the transmission lever 14 can be pivoted by rotation of the latch nut 6, which leads to displacement of the driving rod into the open position.

I claim:

1. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), and wherein the latch nut (6) is blocked against rotation in a blocking position of the blocking member (7).

2. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), and wherein the blocking member (7) is constructed as a nut.

3. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), wherein blocking function is performed by a blocking arm (8) and release function is performed by a release are (9) of the blocking member, and wherein the blocking arm (8) of the nut (6) engages under a blocking shoulder (11) of the driving rod (3).

4. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), wherein a release arm (9) of the latch nut (6) works against a pawl (10) which holds the driving rod (3), and wherein the pawl (10) engages in a tooth system (12) of the driving rod (3).

5. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), wherein an actuating arm (13) of the latch nut (6) engages a transmission lever 14 which engages the driving rod (3), and wherein a shorter arm of the transmission lever (14) forms a drive cam (15) which lies with play in a notch (16) of the actuating arm (13).

6. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), wherein an actuating arm (13) of the latch nut (6) engages a transmission lever (14) which engages the driving rod (3), and wherein a bearing shaft (17) of the transmission lever (14) extends through a bore slot of the actuating arm (13).

7. Driving rod lock, in particular a sliding door lock, with at least one driving rod (2, 3) starting from a lock housing (1), for driving at least one bolt element (4), wherein the at least one driving rod (2, 3) is displaceable by means of energy stored in an energy storing device (5) after release of the energy storing device (5) by discharge from a ready-to-close position into a closed position, wherein the energy storing device (5) is loadable by actuation of a latch nut (6) upon return of the at least one driving rod (2, 3) and released by a release mechanism, wherein the release mechanism is formed by a blocking member (7) which holds the at least one driving rod (2, 3) in the closed position against return by the latch nut (6), wherein the blocking member (7) in its release position is blocked from moving by a device preventing faulty operation (19), which forms a tracer (20), and wherein the device preventing faulty operation (19) is a two-armed lever whose first arm forms the tracer (20) which extends beyond a cuff plate and whose second arm forms a blocking step (21) which cooperates with a blocking shoulder (22) formed by a release arm (9) of the nut.

* * * * *